US007268699B2

(12) United States Patent
Tsai

(10) Patent No.: US 7,268,699 B2
(45) **Date of Patent: *Sep. 11, 2007**

(54) HIGHWAY-RAIL GRADE CROSSING HAZARD MITIGATION

(75) Inventor: John C. Tsai, Saratoga, CA (US)

(73) Assignee: Fibera, Inc., Santa Clara, CA (US)

( * ) Notice: Subject to any disclaimer, the term of this patent is extended or adjusted under 35 U.S.C. 154(b) by 334 days.

This patent is subject to a terminal disclaimer.

(21) Appl. No.: 10/906,800

(22) Filed: Mar. 7, 2005

(65) Prior Publication Data

US 2006/0022063 A1 Feb. 2, 2006

Related U.S. Application Data

(60) Provisional application No. 60/521,189, filed on Mar. 6, 2004.

(51) Int. Cl.
*G18G 1/00* (2006.01)
*G08B 13/00* (2006.01)

(52) U.S. Cl. ..... 340/901; 340/541

(58) Field of Classification Search ..... 340/665, 340/666, 541, 907–932.1, 933, 944, 901–905; 104/307, 18–20, 27, 28; 246/1 R, 1 C, 111, 246/117, 174, 473 R, 473.1, 486; 702/33, 702/41–44; 701/300–302, 19, 20; 398/140–172
See application file for complete search history.

(56) References Cited

U.S. PATENT DOCUMENTS 3,825,734 A * 7/1974 Jacobs et al. ..... 702/175
4,442,350 A * 4/1984 Rashleigh ..... 250/227.17
4,632,197 A * 12/1986 Karpa ..... 177/163
4,807,027 A * 2/1989 Muto ..... 348/148
4,834,199 A * 5/1989 Bolland ..... 177/163
5,056,884 A * 10/1991 Quinlan, Jr. ..... 385/13
5,124,606 A * 6/1992 Eisenbeis ..... 310/114
5,194,847 A * 3/1993 Taylor et al. ..... 340/557
5,330,136 A * 7/1994 Colbaugh ..... 246/122 R
5,444,885 A * 8/1995 Hanrahan et al. ..... 14/69.5

(Continued)

FOREIGN PATENT DOCUMENTS

DE 3815152 A1 11/1989

(Continued)

*Primary Examiner*—Benjamin C. Lee
*Assistant Examiner*—Jennifer Mehmood
(74) *Attorney, Agent, or Firm*—Raymond E. Roberts; Intellectual Property Law Offices

(57) ABSTRACT

A hazard mitigation system to detect an object in a highway-railway grade crossing. A structure is provided that includes a fixed foundation and a surface layer that is cushionably placed above the foundation, such that the structure is located between tracks at the crossing. At least one sensor is mounted between the surface layer and the foundation. This sensor senses the weight of the object upon the surface layer and provides a sensor signal representative of that weight. A control unit receives the sensor signal, processes it to determine whether the object represents a potential hazard, and, if so generates a warning signal. The sensor can particularly include a pressure or strain gage, or a fiber optic sensor. When a fiber optic sensor is employed, it can particularly include a fiber Bragg grating.

15 Claims, 14 Drawing Sheets

U.S. PATENT DOCUMENTS 5,864,304 A * 1/1999 Gerszberg et al. ..... 340/903
5,913,245 A * 6/1999 Grossman ..... 73/800
6,556,927 B1 * 4/2003 Latta ..... 702/41
6,641,091 B1 * 11/2003 Hilleary ..... 246/473.1
6,980,108 B1 * 12/2005 Gebbia et al. ..... 340/555
7,042,369 B2 * 5/2006 Hill et al. ..... 340/942
2005/0069325 A1 * 3/2005 Cicchiello et al. ..... 398/122

FOREIGN PATENT DOCUMENTS

DK DE3815152 * 11/1989
EP 0875437 A2 * 11/1998

* cited by examiner

EXHIBIT E

| GRADE CROSSING LENGTH (AB) m | GRADE CROSSING SAGGING (CD) m | STRETCH | FREQUENCY SHIFT (Hz) |
|---|---|---|---|
| 5 | 5.00E-03 | 2.00E-06 | 4.00E+08 |
| 5 | 4.00E-03 | 1.28E-06 | 2.56E+08 |
| 5 | 3.00E-03 | 7.20E-07 | 1.44E+08 |
| 5 | 2.00E-03 | 3.20E-07 | 6.40E+07 |
| 5 | 1.00E-03 | 8.00E-08 | 1.60E+07 |
| 4 | 5.00E-03 | 3.12E-06 | 6.25E+08 |
| 4 | 4.00E-03 | 2.00E-06 | 4.00E+08 |
| 4 | 3.00E-03 | 1.12E-06 | 2.25E+08 |
| 4 | 2.00E-03 | 5.00E-07 | 1.00E+08 |
| 4 | 1.00E-03 | 1.25E-07 | 2.50E+07 |
| 3 | 5.00E-03 | 5.56E-06 | 1.11E+09 |
| 3 | 4.00E-03 | 3.56E-06 | 7.11E+08 |
| 3 | 3.00E-03 | 2.00E-06 | 4.00E+08 |
| 3 | 2.00E-03 | 8.89E-07 | 1.78E+08 |
| 3 | 1.00E-03 | 2.22E-07 | 4.44E+07 |
| 2 | 5.00E-03 | 1.25E-05 | 2.50E+09 |
| 2 | 4.00E-03 | 8.00E-06 | 1.60E+09 |
| 2 | 3.00E-03 | 4.50E-06 | 9.00E+08 |
| 2 | 2.00E-03 | 2.00E-06 | 4.00E+08 |
| 2 | 1.00E-03 | 5.00E-07 | 1.00E+08 |
| 1 | 5.00E-03 | 5.00E-05 | 1.00E+10 |
| 1 | 4.00E-03 | 3.20E-05 | 6.40E+09 |
| 1 | 3.00E-03 | 1.80E-05 | 3.60E+09 |
| 1 | 2.00E-03 | 8.00E-06 | 1.60E+09 |
| 1 | 1.00E-03 | 2.00E-06 | 4.00E+08 |

TABLE 1

EXHIBIT E

EXHIBIT E

EXHIBIT E

EXHIBIT E

EXHIBIT E
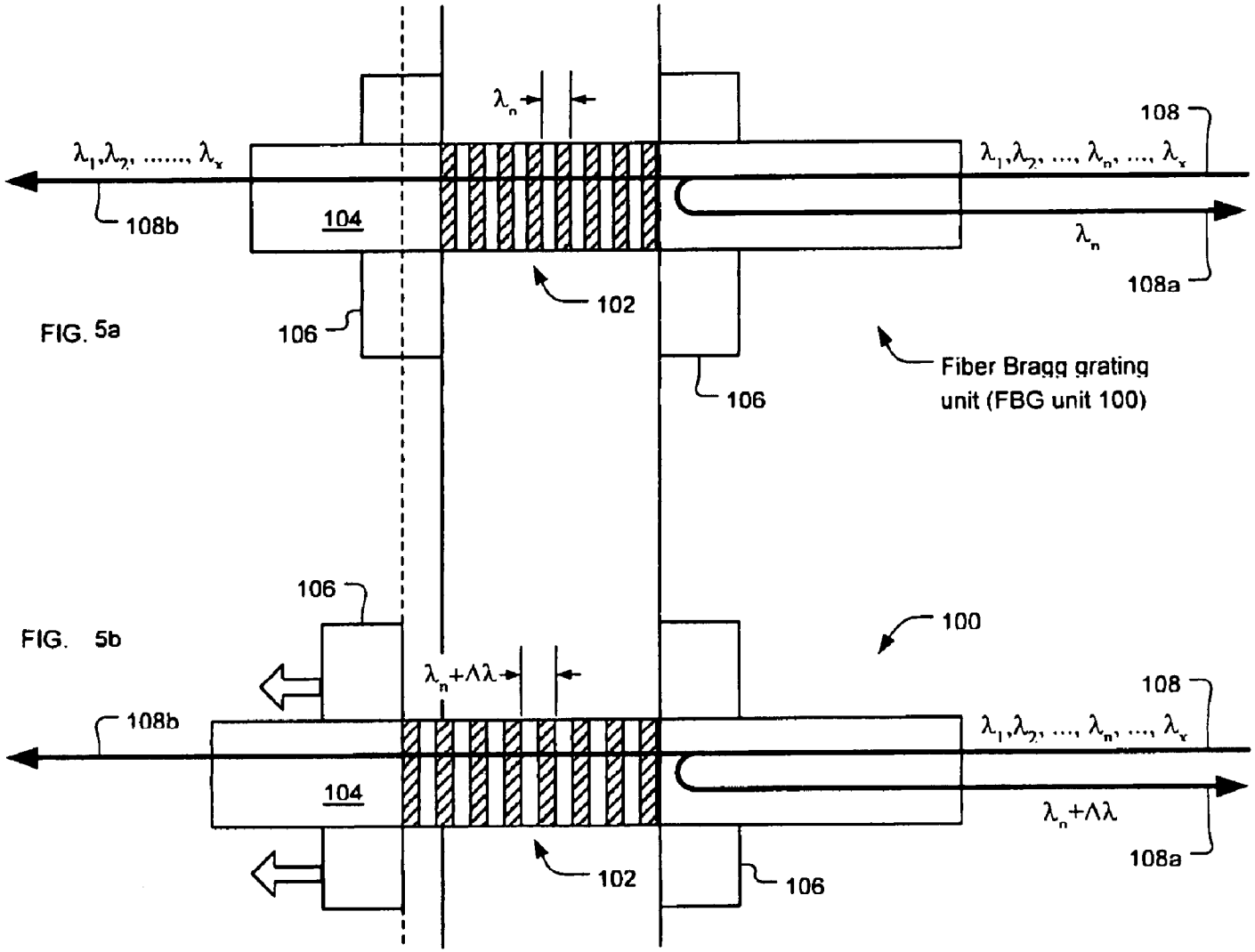

EXHIBIT E

EXHIBIT E

EXHIBIT E

EXHIBIT E

EXHIBIT E

EXHIBIT E

EXHIBIT E

EXHIBIT E

HIGHWAY-RAIL GRADE CROSSING HAZARD MITIGATION

CROSS-REFERENCE TO RELATED APPLICATIONS

This application claims the benefit of U.S. Provisional Application No. 60/521,189, filed Mar. 6, 2004 and this application is related to U.S. Application No. 10/906,801, filed Mar. 7, 2005, both hereby incorporated by reference.

TECHNICAL FIELD

The present invention relates generally to railway safety, and more particularly to such in highway-railway grade crossings.

BACKGROUND ART

Highway-rail grade crossings are a major safety concern for governments, the railway and general transportation industries, communities, and common citizens. Many accidents happen around the world each year and many lives are lost in these accidents. Governments, local communities, and railway companies spend millions of dollars each year improving the safety of highway-rail crossings.

Methods such as laser beam scanning, ultrasonic wave reflection, video cameras, etc. have been used for detecting objects at highway-rail crossings. However, none of these provide effective solutions. For example, a common shortcoming for all of these is that the sensitivity and accuracy are greatly reduced during bad weather conditions. In addition, effective video techniques require human observation at all times.

In this invention, the inventor proposes to use sensors (such as pressure gauges, electrical/mechanical strain gauges, or fiber optic sensors) under the pavement or another platform at a railway grade crossing to detect objects that are stationary in or moving across the grade crossing. With this approach, the presence of such an object triggers a warning signal that the engineer of an approaching train can receive visually or via a telecommunications channel at a safe distance, and take appropriate action if the object is not out of the crossing within a safe period of time.

DISCLOSURE OF INVENTION

Accordingly, it is an object of the present invention to provide a system for highway-rail grade crossing hazard mitigation.

Briefly, one preferred embodiment of the present invention is a system for mitigating the potential hazard caused by an object in a highway-railway grade crossing. A structure is provided that includes a fixed foundation and a surface layer that is cushionably placed above the foundation. This structure is located between tracks at the crossing. At least one sensor is mounted between the surface layer and the foundation, to sense the weight of the object upon the surface layer and provide a sensor signal representative of that weight. A provided control unit receives the sensor signal, process it to determine whether the object represents a potential hazard, and, if so, then generates a warning signal.

An advantage of the present invention is that it can detect and report objects that vary considerably in weight, and thus objects that are both themselves put at hazard by a train entering the grade crossing or objects that put a train at hazard by entering the grade crossing.

Another advantage of the invention is that it can detect and report objects that are stationary in or moving across the grade crossing.

Another advantage of the invention is that it may be flexibly configured, to detect overall or localized effects by objects, and it particularly facilitates monitoring multiple crossings or sections of crossings with multiple sensors.

Another advantage of the invention is that the sensors it employs may be robust and made particularly able to withstand and continue to function well in the variety of adverse environments typically encountered at grade crossings.

And another advantage of the invention is that it may employ fiber optic technology, rendering critical elements of the system irrelevant with respect to creating or being affected by electrical interference, permitting economical optical rather than electrical connection of the key sensor elements in the system, and permitting such connection at considerable distance from ultimate sensor signal processing and warning signal generation elements of the system.

These and other objects and advantages of the present invention will become clear to those skilled in the art in view of the description of the best presently known mode of carrying out the invention and the industrial applicability of the preferred embodiment as described herein and as illustrated in the figures of the drawings.

BRIEF DESCRIPTION OF THE DRAWINGS

The purposes and advantages of the present invention will be apparent from the following detailed description in conjunction with the appended tables and figures of drawings in which:

TABLE 1 is a listing of the results of calculations of frequency shift for various grade crossing lengths vs. the amount of sagging.

FIGS. 5*a-b* are simplified schematics depicting the structure and operation of a fiber Bragg grating (FBG) unit that can be used in fiber optic sensors in the hazard mitigation system, wherein FIG. 5*a* shows the FBG unit before a force is exerted and FIG. 5*b* shows it after the force is exerted.

In the various figures of the drawings, like references are used to denote like or similar elements or steps.

BEST MODE FOR CARRYING OUT THE INVENTION

Figure 1:
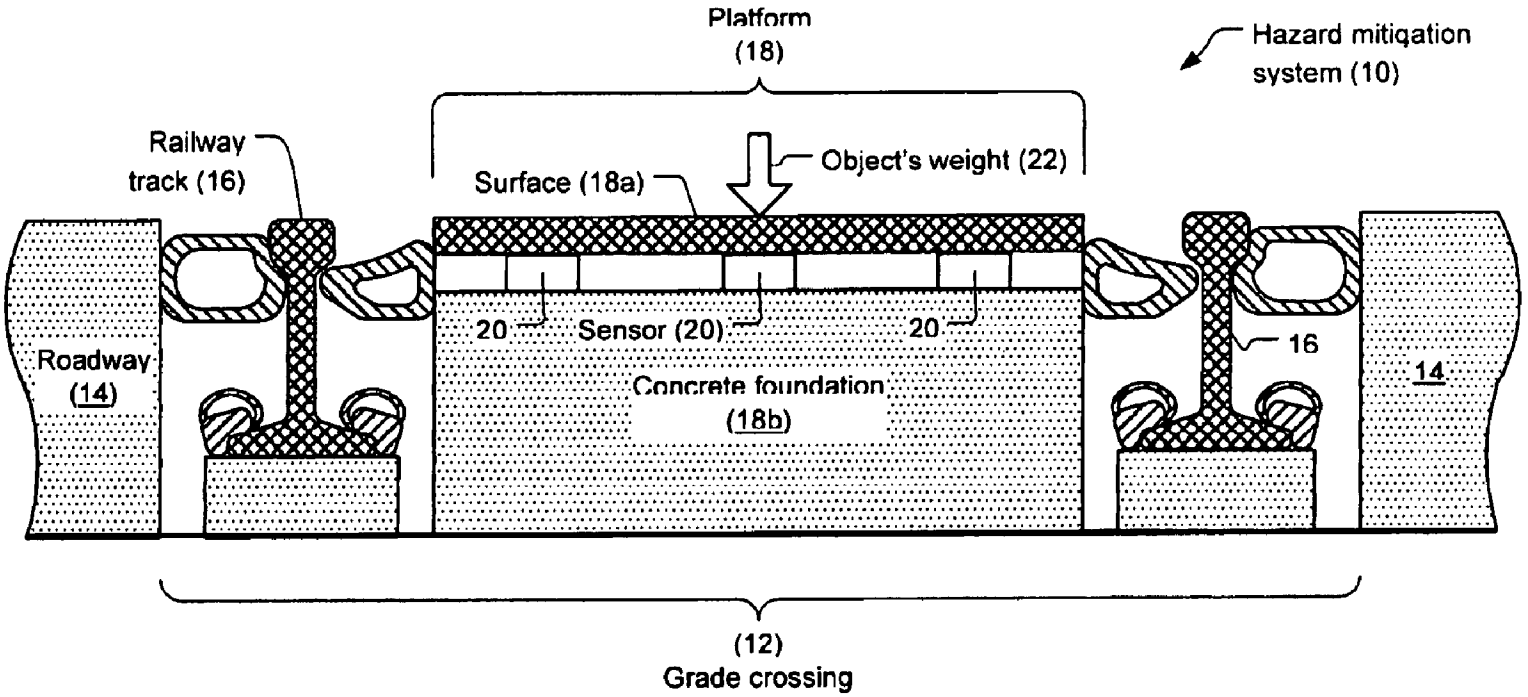
FIG. 1 is a cross sectional schematic of a basic configuration of a hazard mitigation system in accord with the current invention.

A preferred embodiment of the present invention is apparatus and methods for highway-rail grade crossing hazard mitigation. As illustrated in the various drawings herein, and particularly in the view of FIG. 1, preferred embodiments of the invention are depicted by the general reference character 10.

FIG. 1 is a cross sectional schematic of a basic configuration of a hazard mitigation system 10 in accord with the current invention. The hazard mitigation system 10 is used at a railway grade crossing 12 where a roadway 14 crosses tracks 16. In particular, the crossing 12 has pavement or another form of platform (collectively, platform 18) that permits traffic on the roadway 14 to cross over the tracks 16. The platform 18 can be of various forms. FIG. 1 depicts one simplified example having a surface layer 18*a* that can be of concrete, rubber, or other suitable materials, and here is of steel. FIG. 1 further depicts the platform 18 having a foundation 18*b* of concrete, although other materials may also be suitable as well.

The hazard mitigation system 10 includes one or, typically, more sensors 20 that are placed to detect an object 22 (stylistically represented in FIG. 1 by an arrowed line) on the platform 18. When such an object 22 is in the crossing 12 its weight exerts a downward force (pressure) on the surface layer 18*a* of the platform 18, which in turn transfers this force to the sensors 20. The sensors 20 then measure the amount of force and produce a signal that is representative of the weight of the object 22. This signal is sent to a nearby processor (see e.g., FIG. 13). In preferred configurations, the processor calculates the estimated moving speed of the object 22 and determines if conditions will be safe for a train (or any other mechanism running on the tracks 16) to approach the crossing 12. If the speed of the object 22, if any, is determined to be slow enough to jeopardize the object 22 or an oncoming train, the processor can then issue a warning to the train engineer or other suitable parties.

The sensors 20 employed by the hazard mitigation system 10 may be of three general types: pressure gauges 20*a*, mechanical strain gauges 20*b*, and fiber optic sensors 20*c*.

FIG. 1 shows three pressure gauges 20*a* being used for detecting an object 22 (or objects 22) in the crossing 12. In configurations of this type, one or more pressure gauges 20*a* can be placed directly under the surface layer 18*a* of the platform 18 as shown. Each pressure gauge 20*a* measures the local pressure near it and, depending on the nature of the surface layer 18*a*, the weight of the object 22 can either be distributed evenly over the entire surface layer 18*a* or localized to one or more parts of it. If the weight is evenly distributed, what the pressure gauges 20*a* measures becomes an average of the weight of the object 22. If the weight is localized, the respective part or parts of the surface produce local pressures (i.e., the surface layer 18*a* is effectively divided into many discrete units) and each pressure gauge 20*a* measures the pressure within its own locality (see also, e.g., FIGS. 4*a-c*).

Figure 13:
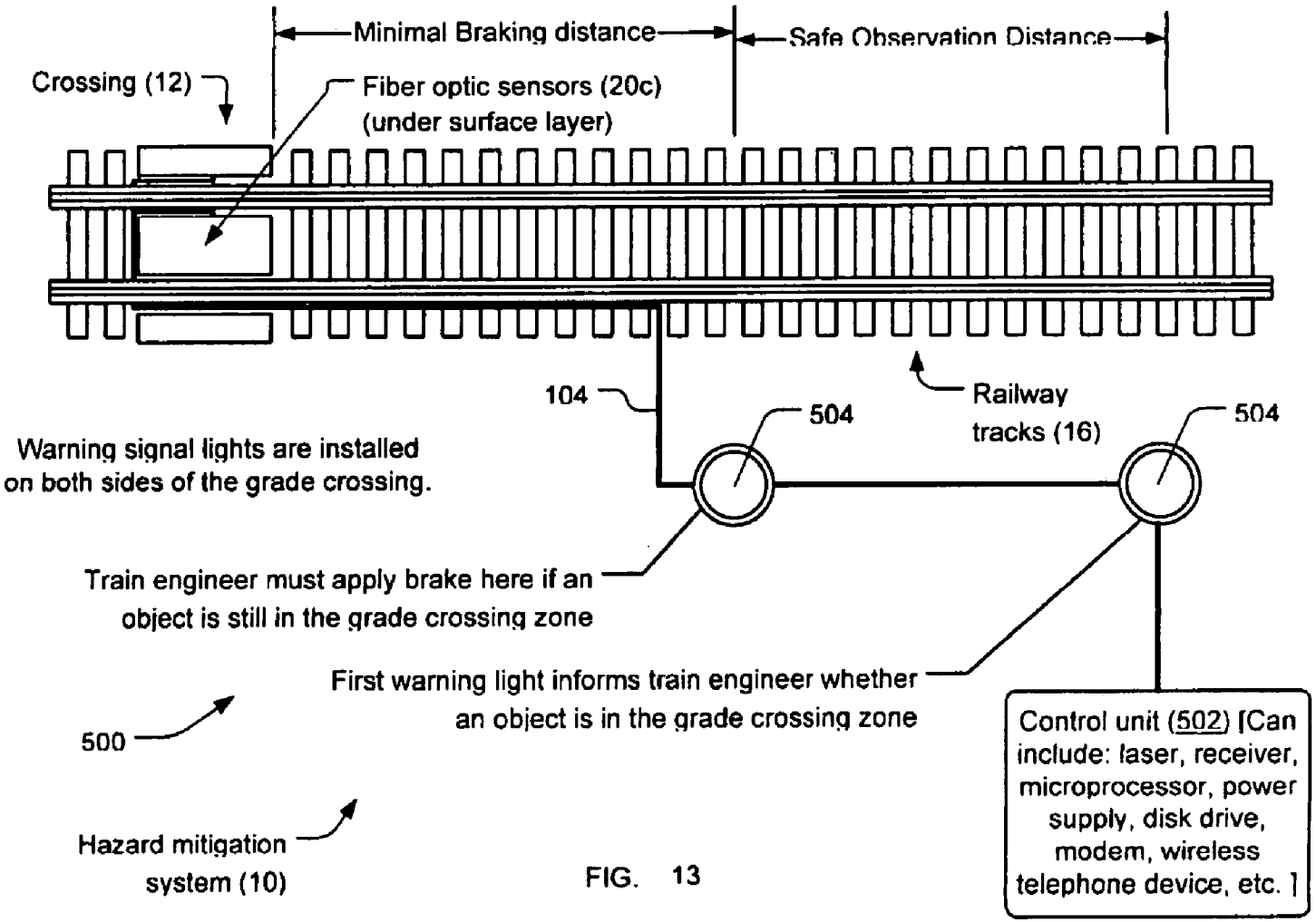
FIG. 13 is a schematic showing a simplified top view of a complete exemplary configuration of the inventive hazard mitigation system.

Since most pressure gauges 20*a* are made from electronic devices, electrical wires are needed to connect them to a power source and to the processor (see e.g., FIG. 13). In general, a minimum of three conductive wires are needed for this: +V, ground, and signal.

The processor used preferably includes a mini or microcomputer to direct measurement command issuance, data acquisition, perform calculations, activate warning signal, and handle telecommunication functions. The processor, power supply, and optional other apparatus are preferably contained in a card cage (i.e., they occupy or comprise a housed control unit) that can be placed in the zone around the grade crossing, in a near-by train station, or at a centralized or other convenient location. The various considerations for placement include, without limitation, electrical power delivery, acquired signal delivery, protection from random or deliberate equipment abuse, etc. Details of warning activation, data acquisition, and telecommunications functions are discussed presently.

Figure 2:
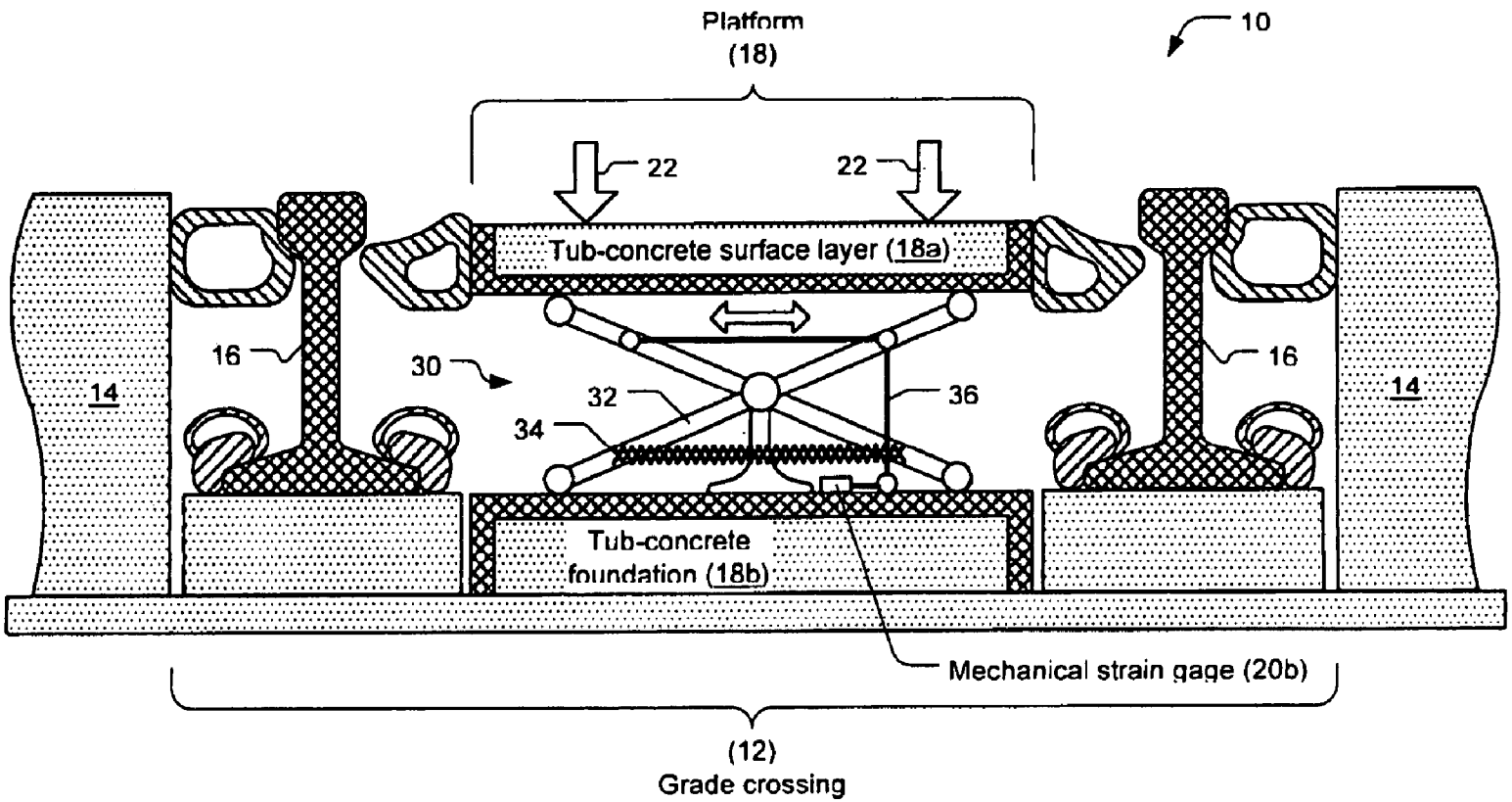
FIG. 2 depicts an example hazard mitigation system using a mechanical strain gauge in a support structure of spring loaded crossbars.

FIGS. 2-4 are cross sectional schematics showing some examples of strain gauges 20*b* (electrical or mechanical) being used by the hazard mitigation system 10 for detection of objects 22. An important aspect in all of these examples is that the weight of an object 22 on the platform 18 activates one or more of the strain gauges 20*b*.

FIG. 2 depicts an example hazard mitigation system 10 using a strain gauge 20*b* in a support structure 30 including crossbars 32 connected by a spring 34. A tension wire 36 is attached at one end to the support structure 30 so that the strain gauge 20*b* is activated.

The platform 18 here again includes a surface layer 18*a* and a foundation 18*b*, with both now being steel tubs filled with concrete. The tension wire 36 used is preferably a low thermal expansion type (e.g., of Invar or Kovar), and will typically be pre-tensioned as appropriate to ensure that a desired range of weights for various objects 22 triggers the strain gauge 20*b* being used. Only one support structure 30 and strain gauge 20*b* are shown in FIG. 2, but more can also be used (see e.g., FIG. 8*b*).

Figure 3A:
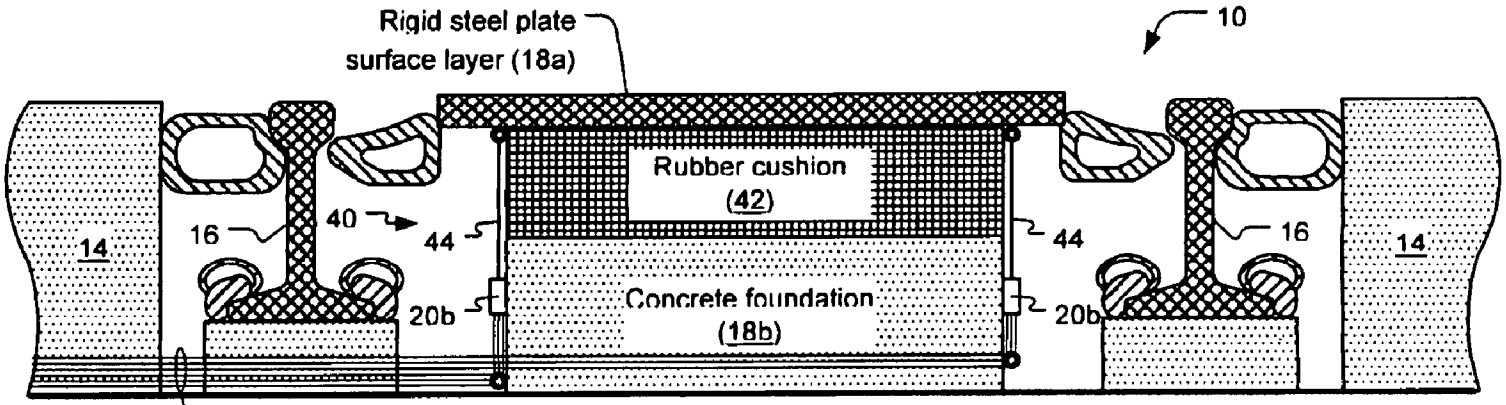
FIGS. 3*a-b* depict before and during cases of an alternate hazard mitigation system that uses two mechanical strain gauges in a rubber cushion structure.
Figure 3B:
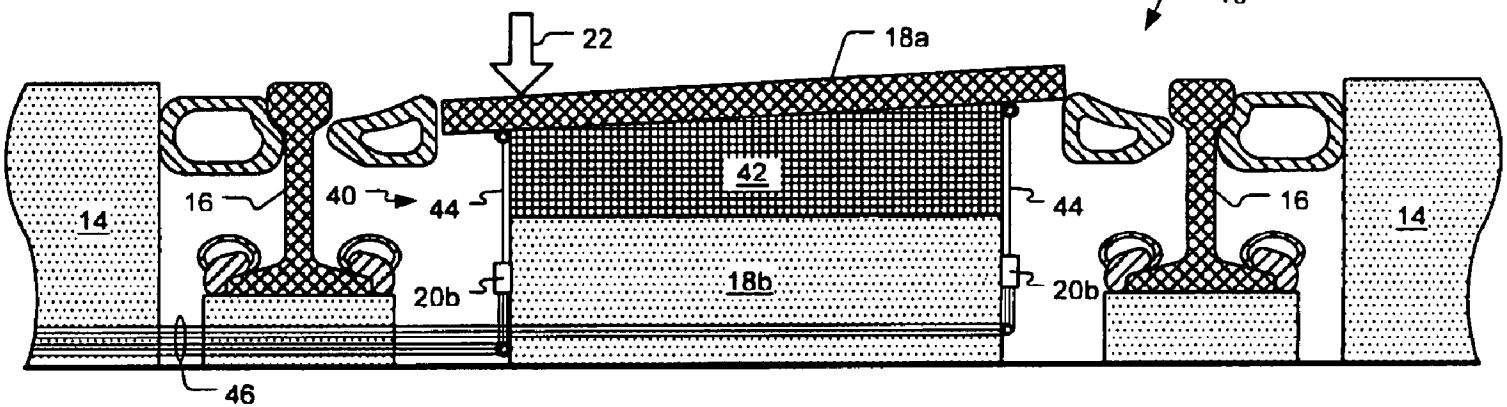

FIGS. 3*a-b* depict before and during cases of an alternate example hazard mitigation system 10 being used to detect an object 22 on the platform 18. This embodiment use two strain gauges 20*b* in a cushion structure 40 that can be as simple as the rubber cushion 42, shown. The strain gauges 20*b* are mounted on opposite sides of the foundation 18*b*, and are each operated by a tension wire 44 that is attached to the surface layer 18*a* (here a rigid steel plate). The strain gauges 20*b* are shown here "wired," having electrical wiring 46 to power them and return signals from them to a processor (not shown).

The tension wire 44 used here is also preferably a low thermal expansion type that is pre-tensioned as desired. Only one cushion structure 40 is shown, but more can be used or more than two strain gauge 20*b* can be mounted on one in straightforward manner.

Figure 4A:
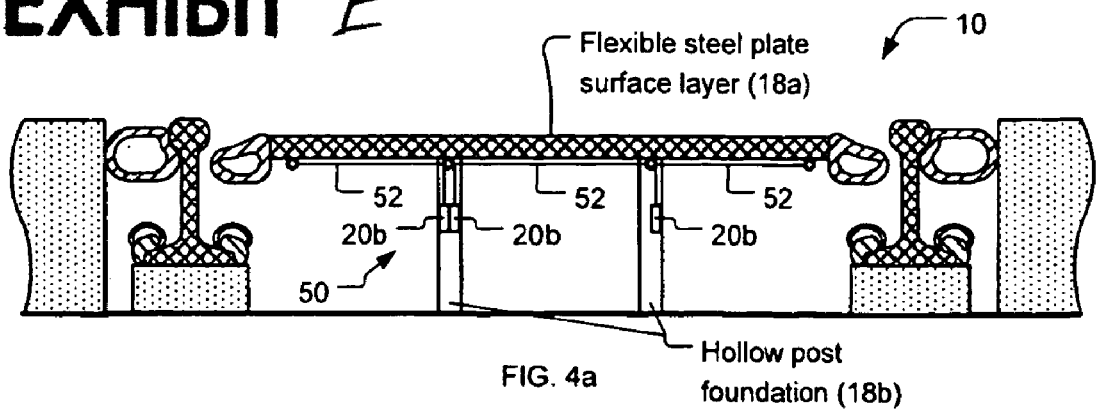
FIGS. 4*a-c* depict before, during, and during cases of an another alternate hazard mitigation system that uses three mechanical strain gauges in an arrangement between a flexible steel plate surface layer and a hollow post foundation.
Figure 4B:
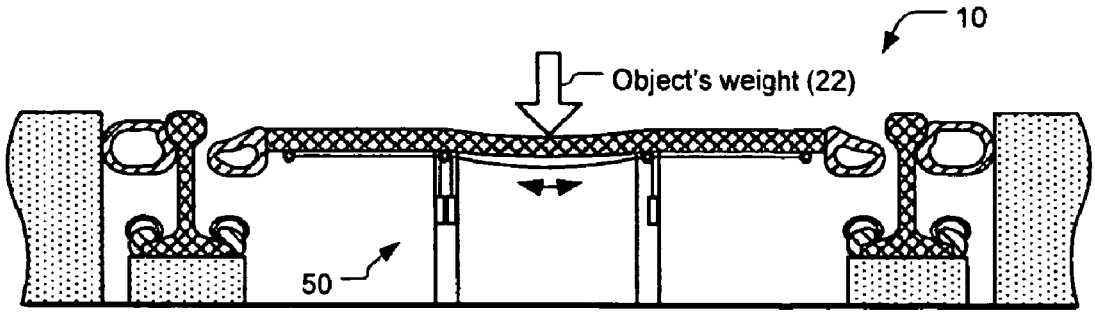
Figure 4C:
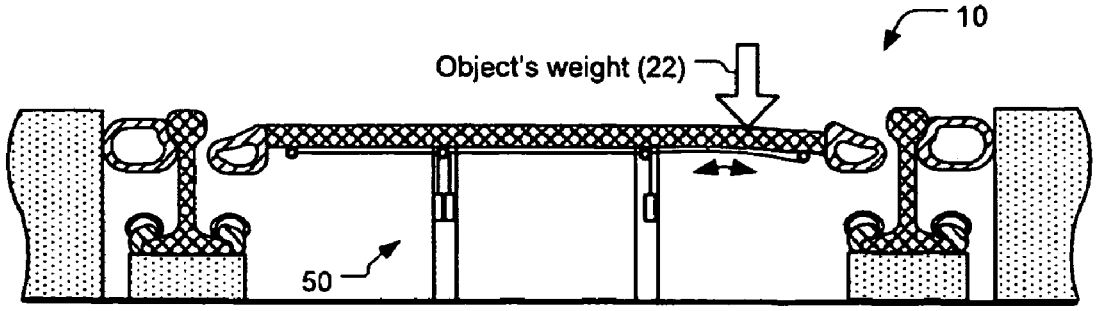

FIGS. 4*a-c* depict before, during, and during cases of an another alternate example hazard mitigation system 10 being used to detect objects 22 on the platform 18. This embodiment uses three strain gauges 20*b* in a mounting arrangement 50 between a flexible steel plate serving as a surface layer 18*a* and hollow posts forming a foundation 18*b*. The strain gauges 20*b* are mounted on the posts in the foundation 18*b* and are attached to the surface layer 18*a* by appropriate tension wires 52.

Although these examples in FIGS. 2-4 are much more sophisticated mechanically than the configuration in FIG. 1, by comparison it can be appreciated that the same basic principles are being employed.

Configurations of the invention using any of the three types of sensors 20 may be applied similarly to ensure that a crossing 12 is cleared when a train is approaching. In view of this similarity, and because those in the railway industry are probably least familiar with fiber optics technology, we have reserved more detailed discussion of exemplary configurations for one using fiber optic sensors. Other than the sensor technology used, however, the underlying principles and structural considerations are essentially the same for all configurations of the invention, and large portions of the following discussion therefore apply in straightforward manner to all of the configurations.

I. The Fiber Optic Sensor and Detector

For the following discussion of example some configurations of the inventive hazard mitigation system 10 employing fiber optics technology, the overall mechanism is treated as consisting of three general parts: a fiber optic sensor and detector; a grade crossing structure; and a signal generation, propagation, and notification processor.

An alternate to electrical sensors (e.g., the pressure gauges 20*a*, discussed above) or mechanical sensors (e.g., the strain gauges 20*b*, also discussed above) is fiber optic sensors 20*c*. These have light propagated in optical fiber and do not require electricity in signal transmission. In addition, one optical fiber can carry many signals and distribute them to multiple sensors. This greatly reduces the quantity of wiring need and eliminates the risk of electrical interference. Another advantage is that optical fiber does not rust or easily degrade in humid environments. In addition, light signals can be multiplexed and de-multiplexed in very convenient ways.

Several types of fiber optics based sensors can be used here. Some examples include the fiber Bragg grating, the fiber optic Fabry-Perot grating, the Mach-Zehnder interferometer, the Fizeau interferometer, and fiber optic Michelson interferometer, etc. All of these types of fiber optics based sensors permit comparing optical frequency shift before and after a sensor 20 has encountered a physical dimension change due to the weight of an object 22.

To simplify this discussion, only the example of the fiber Bragg grating (FBG) is used in the fiber optic sensors 20*c* described next. Once the principles of configurations using that type of sensor-technology are grasped, those of ordinary skill in the art should be able to determine when it is appropriate and how to employ the other types of fiber optic sensors.

The fiber optic sensors 20*c* employed here can be a FBG type mounted on or embedded in the platform 18 at a railway grade crossing 12, with an adequate number of such sensors 20 used to permit the entire grade crossing 12 to be monitored.

FIGS. 5*a-b* are simplified schematics depicting the structure and operation of a FBG unit 100 that can be used in the fiber optic sensors 20*c* of the hazard mitigation system 10. FIG. 5*a* shows the FBG unit 100 before a force is exerted, and FIG. 5*b* shows the FBG unit 100 after the force is exerted.

For simplicity, the FBG unit 100 here is one having an FBG zone 102 that is integral to an optical fiber 104 held in mounting blocks 106. FBGs are frequently manufactured in optical fibers in this manner. Alternately, they can be discrete and then connected by optical fibers. In view of the total number and the typically different lengths of optical fiber needed, discrete FBGs with connecting optical fibers may be used in many embodiments of the hazard mitigation system 10. This is essentially a matter of design choice.

For use, a light source, usually a laser at the processor (see e.g., FIGS. 6-7, discussed presently), produces a light beam 108 having one or more light wavelengths, e.g., $\lambda_1, \lambda_2, \ldots \lambda_n \ldots \lambda_x$ in FIGS. 5*a-b*. For the hazard mitigation system 10 the FBG unit 100 is mounted to a structure so that it is initially in resonance with a wavelength in the light beam 108, e.g., $\lambda_n$. This light beam 108 is sent out via the optical fiber 104 to the FBG zone 102.

As summarized in FIGS. 5*a-b*, when a particular light wavelength is in resonance with a particular FBG zone 102 the portion of the light beam 108 of that wavelength ($\lambda_n$) is reflected back as a reflected beam 108*a* along the original path from which it came. Any other light wavelengths, e.g., $\lambda_1, \lambda_2, \ldots \lambda_x$, will not be in resonance and instead pass as a passed beam 108*b* through the FBG zone 102. If a beam splitter or coupler has been provided in the path of the original/reflected light (the beams 108, 108*a*), it can divert all or part of the reflected beam 108*a* to a photodetector, where a signal related to the light reflected in the particular FBG unit 100 is then produced. (See e.g., FIGS. 6-7.)

The phenomenon responsible for this follows the Bragg condition:

$$\lambda_B = 2n_{eff}\Lambda,$$

where $n_{eff}$ is the relative index of refraction between high (e.g., erbium doped) and low (the original optical fiber) materials. The physical length of the high-low period is $\Lambda$ and $\lambda_B$ is the resonant wavelength.

When the FBG unit 100 is stretched (or compressed) along its longitudinal direction (in FIG. 5*b* this is done by moving the left mounting block 106), $\Lambda$ changes accordingly. For example, assuming the stretch of the optical fiber 104 at the FBG zone 102 causes $\Lambda$ to change by 10-5, the resonant wavelength changes proportionally, which is equivalent to a 2 GHz shift in optical frequency. Such a significant shift can easily be detected. For instance, Fibera, Inc. of Santa Clara, Calif. makes equipment suitable for this. The present inventor has abundant experience producing fiber optic sensors that have sensitivity suitable to detect weight levels ranging from those of low-weight objects (e.g., a dog) to heavy objects (e.g., a truck).

Many railway grade crossings 12 experience wide variations in temperature, and the process of detecting objects with FBG units 100 will therefore often need to be temperature independent. Various approaches may be used to provide for this. Athermal FBGs are available and can be used, or non-athermal FBGs can be used and "normalized." For instance, the temperature can be conventionally measured and compensated for by the processor. Or two FBGs can be placed close together and used in a differential manner. Both FBG zones 102 are then equally affected by temperature but only one is stressed by the weight of an object 22, and any net difference between what is detected represents the weight of the object 22 in the crossing 12.

Accordingly, to employ its characteristic nature usefully here, a FBG unit 100 is arranged so that when an external longitudinal force is applied, the pitch of the FBG zone 102 changes and causes the resonance wavelength of the FBG unit 100 to also change. A detector then can detect this wavelength change and provides a signal that is representative of the magnitude of the change. In the case of the present invention, the source of the force is the weight of an object 22 on the railway grade crossing 12.

In many fiber optic sensor based configurations, it is desirable and can be expected that multiple sensors 20 will be used. The connection of the sensors 20 can then be in parallel, in a serial or "Daisy chain" configuration, or in various combinations of these. The inventor anticipates that in most cases both parallel and Daisy chain configurations will be used together, to make an overall configuration more effective.

Figure 6:
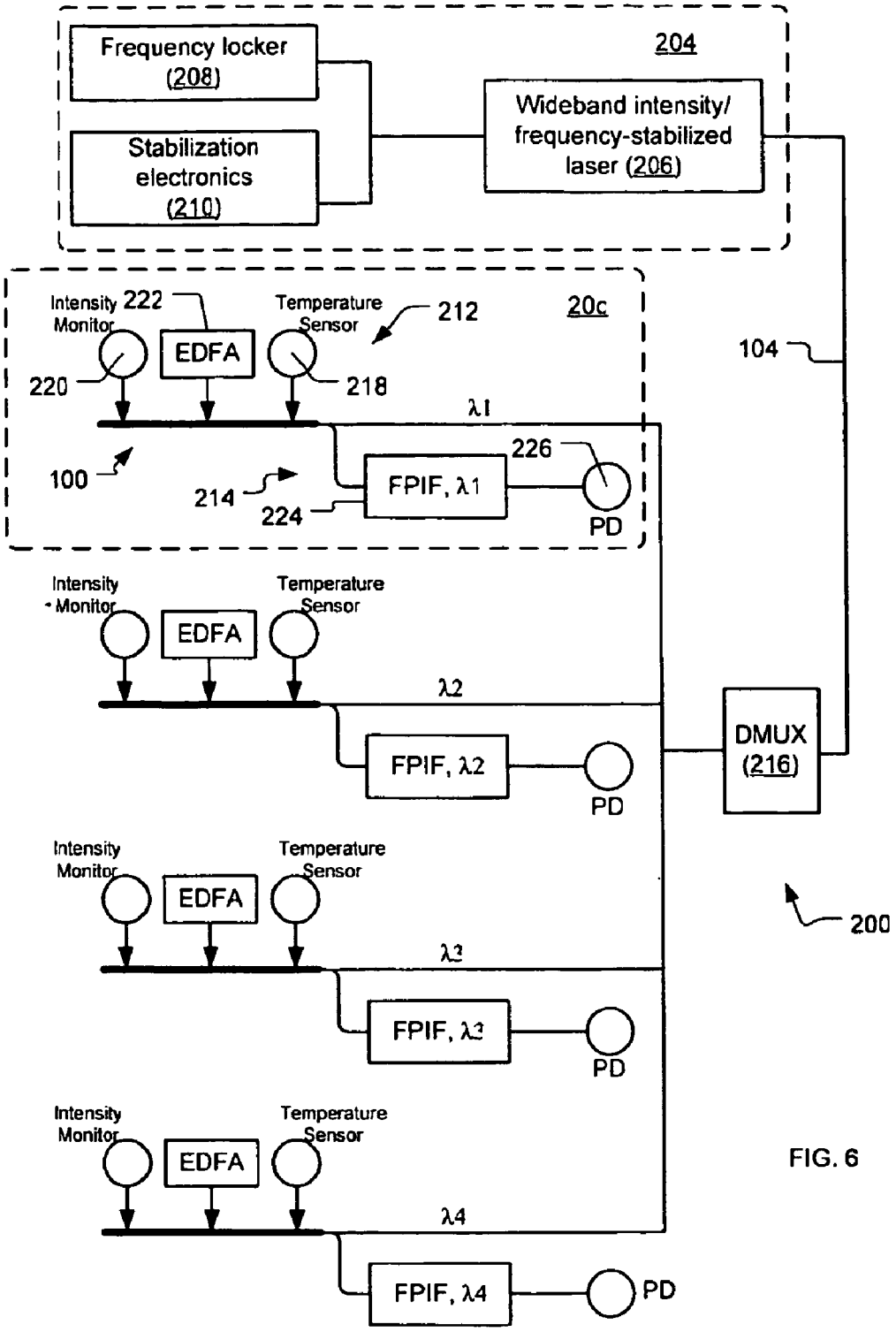
FIG. 6 is a schematic showing how an ensemble of fiber optic sensors based on FBG units can be connected in a parallel configuration.
Figure 7:
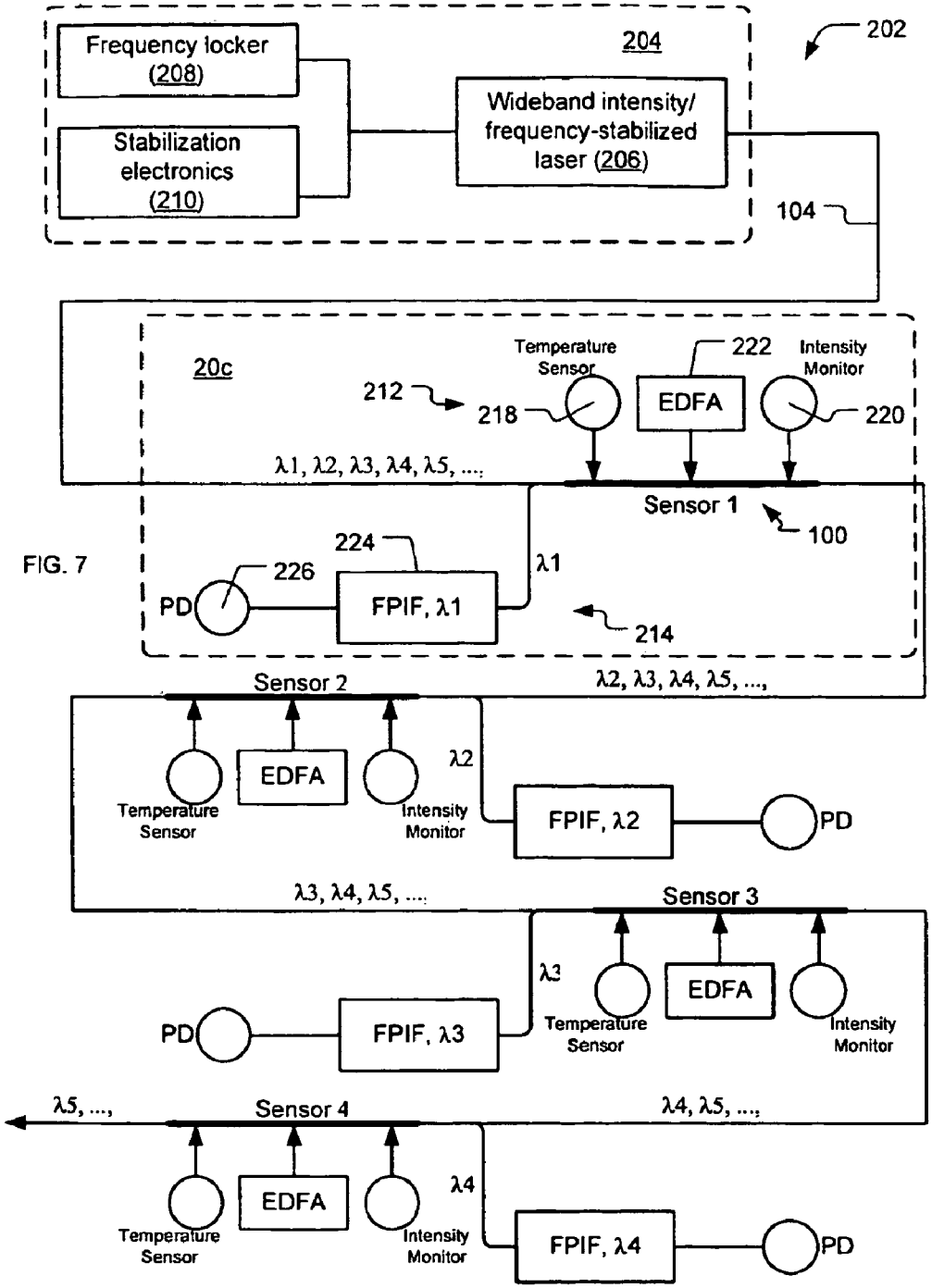
FIG. 7 is a schematic showing how an ensemble of fiber optic sensors based on FBG units can be connected in a serial or Daisy chain configuration.

FIG. 6 is a schematic showing how an ensemble of fiber optic sensors 20*c* based on FBG units 100 can be connected in parallel configuration 200, and FIG. 7 is a schematic showing how an ensemble of fiber optic sensors 20*c* based on FBG units 100 can be connected in a serial or Daisy chain configuration 202. These particular examples are of technology employed by the inventor in other applications and the sets of elements shown in these examples are not put forth as being novel. Rather, the present invention encompasses the application of sets of elements like those in FIGS. 6-7 in combination with the other elements and principles of operation set forth herein for the hazard mitigation system 10.

A light source 204 used in these particular examples is intensity and frequency stabilized, having a laser 206, a frequency locker 208, and a stabilization unit 210. The light source 204 provides light used by multiple sensor modules 212 and filter modules 214. In FIG. 6 a demultiplexer (DMUX 216) separates the multiple light wavelengths used. In the configuration in FIG. 7 such separation is not necessary. The sensor modules 212 here each consist of a FBG unit 100, a temperature sensor 218, an intensity monitor 220, and an erbium doped fiber amplifier (EDFA 222). The filter modules 214 here work in intensity mode, and each consists of a Fabry-Perot interference filter (FPIF 224) and a photodetector 226 (PD). The FPIF 224 is arranged to be in resonance with the frequency locker 208. Both the sensor modules 212 and the filter modules 214 here are sophisticated types that permit considerable correction for signal attenuation, variation, and degradation that are not attributable to the weight of an object 22, and thus permit determining the weight with a high degree of accuracy and reliability. In many applications, such degrees of accuracy may not be needed and simpler units can be used then.

II. The Grade Crossing Structure.

FIGS. 8-11 are schematics showing some examples of structures at railway grade crossings 12 that are in accord with the present invention. For our purposes now these structures are treated as consisting of a surface layer, a detection layer, and a foundation. Generally, the detection layer can be viewed as including a cushioning mechanism that can be constructed from any materials as long as it has the right balance between elasticity and stiffness so that a heavily loaded truck (acting as an object 22) can pass through the crossing 12 without too much sagging, yet produce adequate deformation to the detection layer so that one or more sensors 20 (in the following examples, fiber optic sensor 20*c*) receive the force. The cushioning mechanism then recovers to its un-deformed condition after the object 22 has passed through the crossing 12. Some example candidates for the cushioning mechanism, without limitation, can be steel springs, steel beams, air-spaced enclosed steel casings, etc. As will be seen in the following examples, the space in-between can then be either empty or filled with rubber-like or other suitable materials.

Figure 8A:
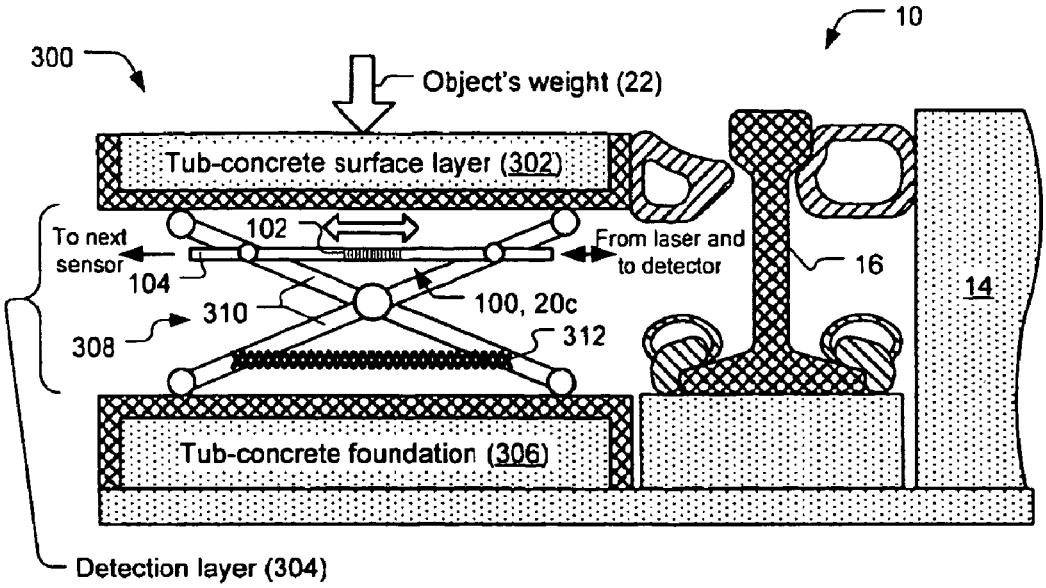
FIG. 8*a* shows a side cross-sectional and partially cutaway view of a grade crossing structure including a spring-frame based detection layer.

FIG. 8*a* shows a side cross-sectional and partially cutaway view of a grade crossing structure 300 that consists of a steel tub filled with concrete surface layer 302, a spring-frame based detection layer 304, and a steel tub filled with concrete foundation 306. The surface layer 302 and foundation 306 can, of course be constructed from the same materials commonly seen today, that is, usually a concrete base or wooden ties. Other materials such as steel can also be used and the decision of the material is purely one of practical design for the specific circumstances and can be made by a civil engineer.

The detection layer 304 includes one or more cushioning mechanisms 308 formed by a set of steel crossbars 310 that are connected and pre-loaded by a spring 312. The detection layer 304 here also includes one fiber optic sensor 20*c* mounted on each cushioning mechanism 308. This is shown in highly stylized manner. In an actual implementation, the FBG zone 102 would actually be small, probably totally invisible to the human eye, and the FBG unit 100 and optical fibers 104 would be clad in an opaque material to keep light out. The fiber optic sensor 20*c* is particularly attached to the crossbars 310 so that it can be stretched or compressed when the cushioning mechanism 308 is under pressure from an object 22.

Figure 8B:
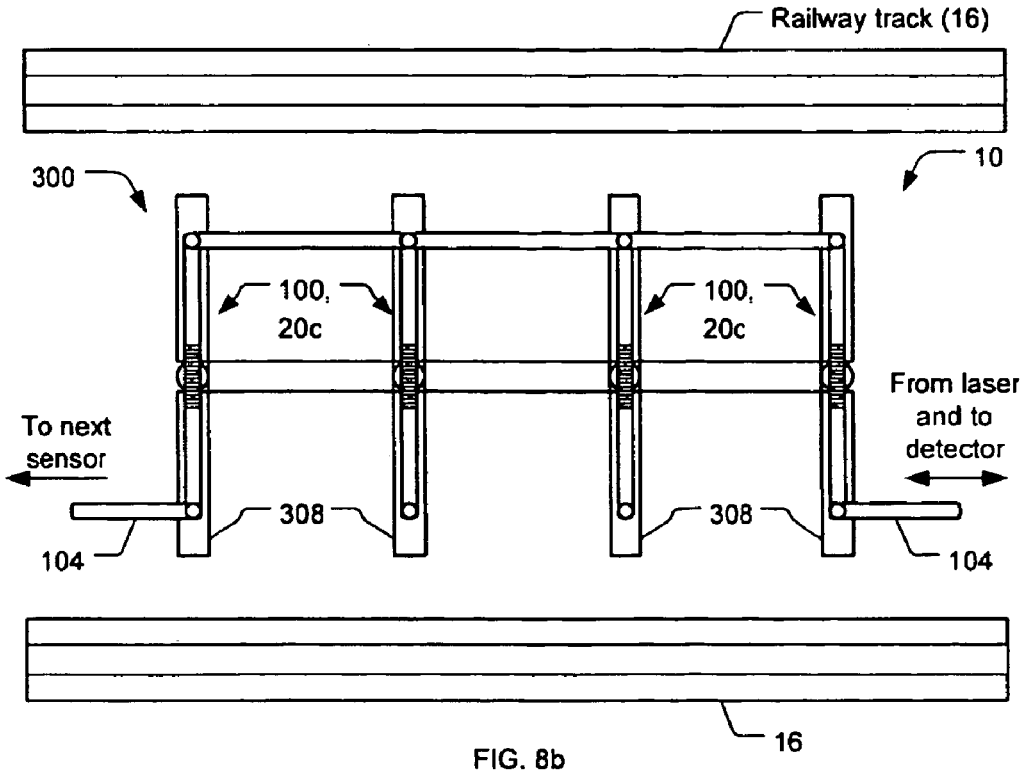
FIG. 8*b* shows a top plan view of the configuration in FIG. 8*a* with the top cover removed.

FIG. 8*b* shows a top plan view of the configuration in FIG. 8*a* with the top cover (surface layer 302) removed. Here it can be seen how multiple sets of the cushioning mechanism 308 can be used to either share the load evenly or to be discretely positioned to measure local loads individually.

Figure 9A:
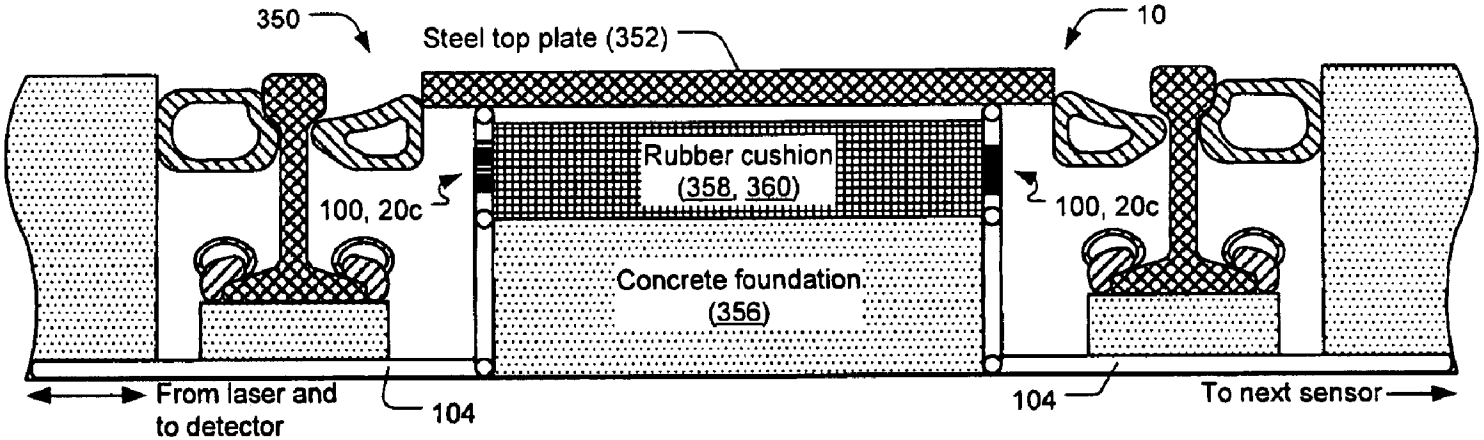
FIG. 9*a-b* show before and during side cross-sectional views of a grade crossing structure including a rubber cushion that is compressed and activates external sensors when a load is applied by an object.
Figure 9B:
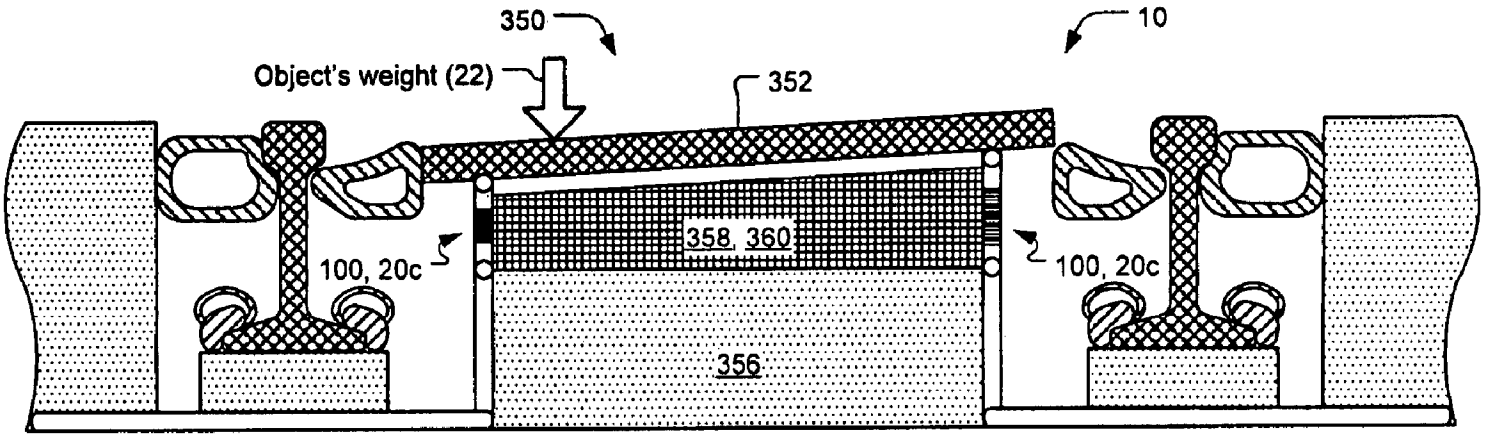

FIG. 9*a-b* show before and during side cross-sectional views of a grade crossing structure 350 that consists of a steel top plate based surface layer 352, a detection layer 354, and a fixed concrete block based foundation 356. With this approach, a cushioning mechanism 358 can be used that is simply a rubber cushion 360 that is compressed when a load is applied by an object 22. Since the fiber optic sensors 20*c* used here are attached to the steel top plate surface layer 352 and also to the concrete block foundation 356, at one end a fiber optic sensor 20*c* is compressed along with the cushion 360. At the other end, another fiber optic sensor 20*c* there stretches along with the cushion 360 as well.

Figure 10A:
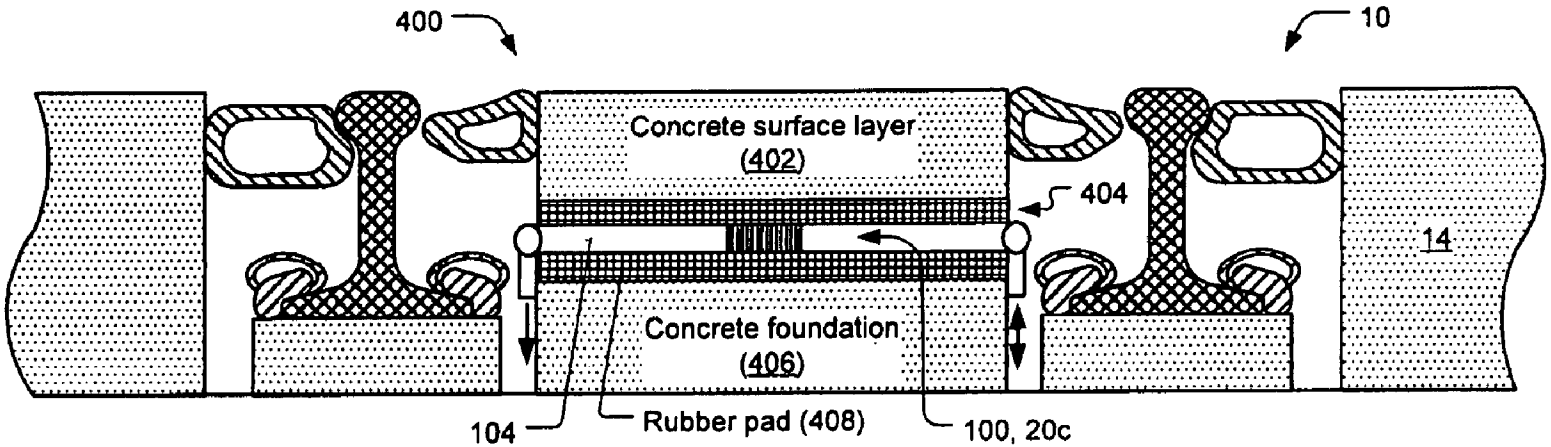
FIG. 10*a-b* show before and during side cross-sectional views of a grade crossing structure including a rubber pad that is compressed and activates an internal sensor when a load is applied by an object.
Figure 10B:
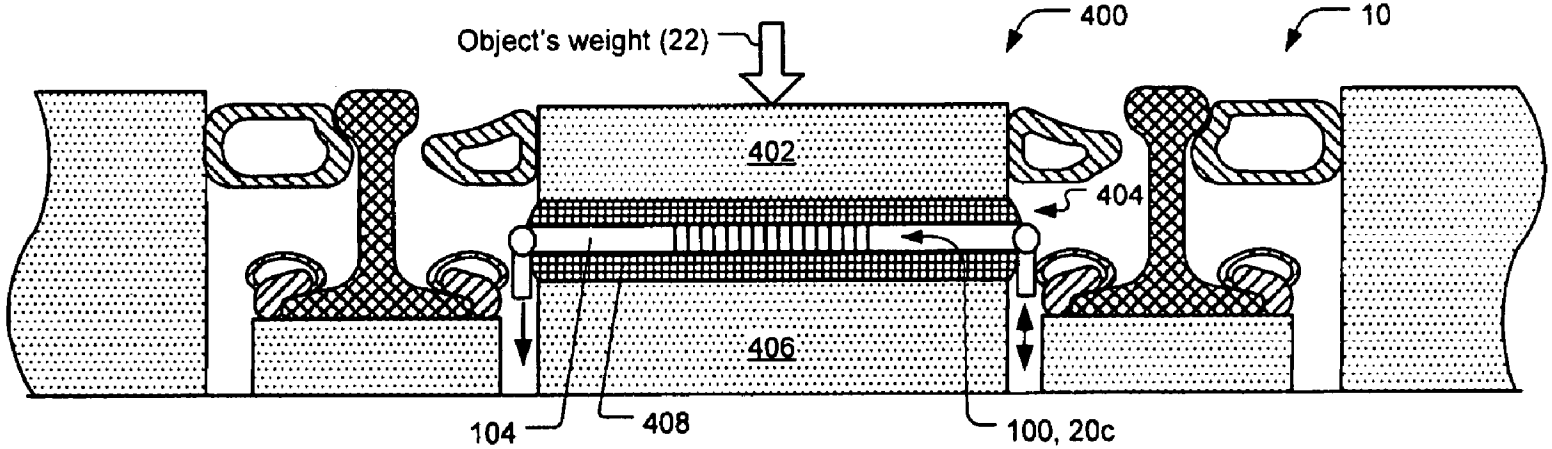

FIG. 10*a-b* show before and during side cross-sectional views of a grade crossing structure 400 that consists of a concrete slab based surface layer 402, a detection layer 404, and a concrete slab based foundation 406.

The detection layer 404 here includes a rubber pad 408 (or equivalent, acting as a cushion mechanism) that is either sandwiched between the two concrete slabs of the surface layer 402 and the foundation 406, or directly under a single concrete slab (not shown here). The optical fiber 104 of the fiber optic sensor 20*c* used here is tightly attached to the peripheral sides of the rubber pad 408. When the concrete slab surface layer 402 is free of weight, the fiber optic sensor 20*c* is in its neutral condition. When the weight of an object 22 (e.g., a van) is applied to the surface layer 402, the pad 408 is compressed vertically and expands horizontally according to the well known Poisson equation. This causes the fiber optic sensor 20*c* to stretch, which changes its resonant wavelength in a detectable manner.

Figure 11A:
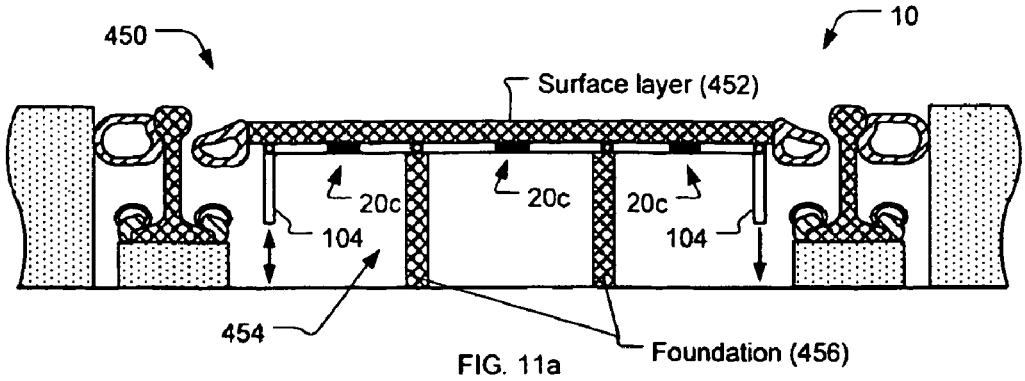
FIG. 11*a-c* show before, during, and other during side cross-sectional views of a grade crossing structure that consists of a flexible steel plate that activates sensors when a load is applied by an object.
Figure 11B:
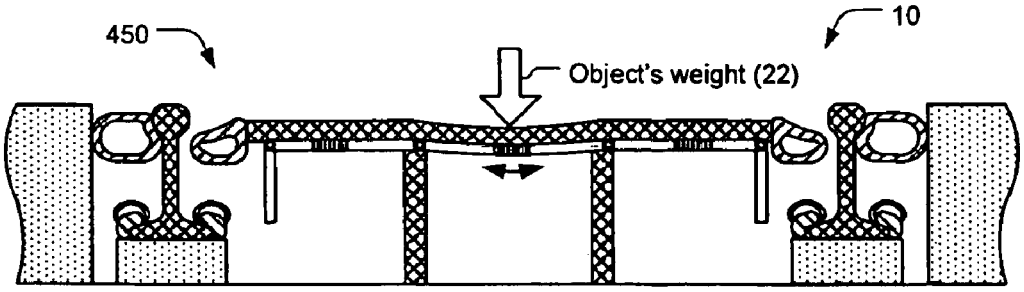
Figure 11C:
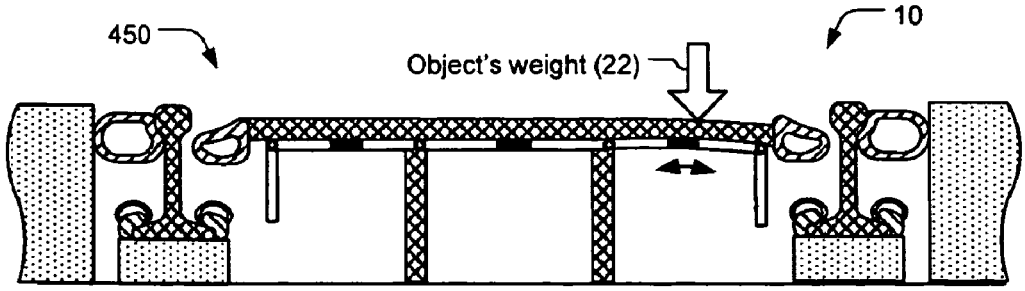

FIG. 11*a-c* show before, during, and other during side cross-sectional views of a grade crossing structure 450 that consists of a flexible steel plate based surface layer 452, a detection layer 454, and a solid steel beam based foundation 456. Of course, the surface layer 452 can be of any material that suitably bends when a load is applied and the foundation 456 can be of hollow steel tubing, concrete pylons, wooden posts, etc. The "cushion mechanism" here is effectively integral to the flexible surface layer 452.

The detection layer 454 in this embodiment of the hazard mitigation system 10 is essentially just fiber optic sensors 20*c* attached to the surface layer 452. Bending at a local section of the surface layer 452 produce a strain at the local fiber optic sensor 20*c*, which changes its resonant wavelength in a detectable manner. A straightforward variation of this approach (not shown) is to instead attach the fiber optic sensors 20*c* to the foundation 456 in a manner that they are also stressed by bending of the surface layer 452.

Figure 12:
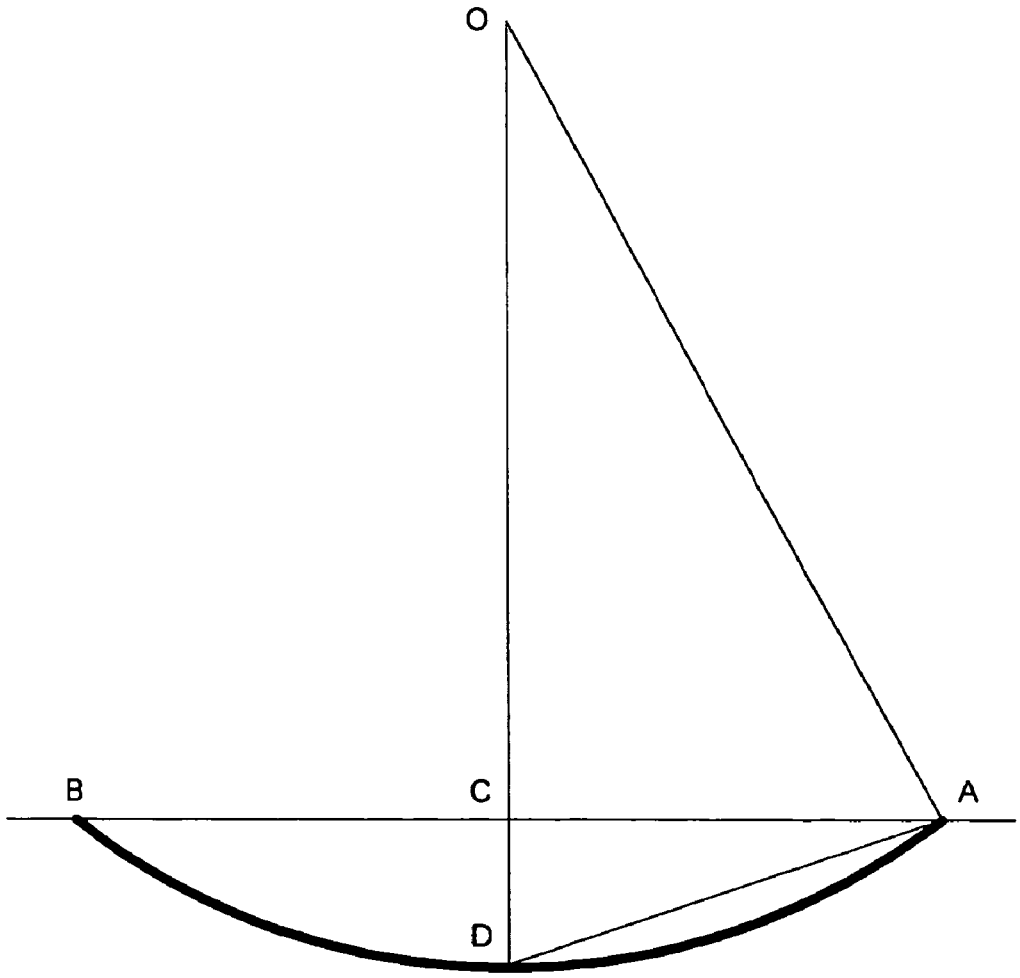
FIG. 12 presents a geometric representation of sagging at a grade crossing due to the weight of an object.

FIG. 12 presents a geometric representation of sagging at a grade crossing 12 due to the weight of an object 22. Assuming AB=5 m is the length of the grade crossing 12 where a fiber optic sensor 20*c* is attached and is sagged by an amount of 2 mm from location C to location D. The length for the arc ADB can then be calculated as OD*2*arcsin(CD/AC)=AC^2*arcsin(CD/AC)/CD=5.0000016 meters. This means the pitch of the FBG zone 102 in the FBG unit 100 is stretched by 1.6*10^−6/5=3.2*10^−7, which is a 64 Mhz frequency shift. This frequency shift can then be measured with suitable electronic circuitry. TABLE 1 shows the results of calculations of frequency shift for various grade crossing lengths vs. the amount of sagging.

III. Signal Generation, Propagation, and Notification.

There are many advantages to using the fiber optic sensors 20*c*. The light beam 108 can propagate through optical fiber 104 for a very long distance without the need for repeaters. Signal propagation distances up to 100 kilometers have been demonstrated in the telecommunications industry. The fiber optic sensors 20*c* also do not generate any electrical interference that can affect train operation or communications. Similarly, unlike electrical type sensors, electrical systems on a train or otherwise present nearby do not affect the fiber optic sensors 20*c*. They function 24 hours a day, 7 days a week.

The use of an all-optical device makes fiber optic sensor based configurations of the hazard mitigation system 10 durable and reliable. The telecommunications industry has demonstrated that fiber optic signal transmission systems can have expected lifetimes of over 20 years. This makes fiber optic sensors 20*c* very attractive for monitoring at grade crossings 12 because it reduces the need for maintenance and repair.

FIG. 13 is a schematic showing a simplified top view of a complete exemplary configuration 500 of the inventive hazard mitigation system 10. A light beam is generated by a light source located in the card cage (control unit 502). The light source can be either a broadband light with its spectrum consisting of all the wavelengths of the various FBGs installed in the grade crossing 12, or it can be a narrow line-width tunable laser.

When a broadband light source (e.g., an LED) is used, all wavelengths are emitted simultaneously to pass through the optical fiber 104 and reach the installed fiber optic sensors 20*c*. Each FBG therein then reflects light from within the provided spectrum at its resonant wavelength. In the return path, between the FBGs and a detector back in the control unit 502, a tunable filter is installed (see e.g., FIGS. 6-7). This tunable filter sweeps through the spectrum of the light source, and allow only one wavelength to pass at a time. Since the wavelength of each FBG will have been recorded during installation, comparison by the processor of recorded information and detected signal magnitudes permits knowing the condition at each location where a FBG is installed.

If a narrow line-width tunable laser is used, it is tuned through its light wavelength gain profile and light is reflected when the tuned wavelength comes into resonance with one of the installed FBGs. In both cases, the reflected light is detected by the detector or receiver, which is also located in the control unit 502.

The resonance wavelengths of the FBGs are designed to be within the bandwidth of the light source spectrum. They are also adequately distinct from each other so there is no overlap during operation, with or without a load being present.

When an object 22 (human being, vehicle, animal, etc.) is in the crossing 12 its weight (gravity force) causes the detection layer to deform. The more weight present, the more deformation occurs. This deformation causes the pitches of the nearby FBGs to change, resulting in shifting of the resonant wavelengths of these FBGs. By comparing the amount of shift in a resonance wavelength from the reflected light, one can determine the estimated location and weight of the object 22.

This wavelength shift phenomenon can be expected to usually be sensed moving from one side of a grade crossing 12 to the other. If the movement is fast, it can reasonably be concluded that the object 22 is a vehicle. And if the movement is slow, it is probably a human being or an animal. If the movement stops in the middle of the grade crossing 12, something special is happening and it may be appropriate for the processor to issue a warning signal.

The preferred control unit 502 consists of a signal comparator, processor, data storage, weather station (optional), and data communications system. These can all be essentially conventional. The signal comparator evaluates the reflected wavelength from each fiber optic sensor 20*c* and compares it with information about the original resonance wavelength. If the difference is significant, a warning signal can be issued. The raw data of the reflected wavelengths is saved in the data storage for archive and possible later analysis purposes. The processor, typically a microprocessor, ensures that the light source is functioning properly; sets the intensity of the light source; sweeps the tunable filter if a broadband light source is used; sweeps the wavelength if a tunable laser is used; activates the data storage; issues a warning signal when the FBGs indicate the existence of an object in the grade crossing zone; acts on commands received from railway staff via a communications channel; and records temperature, humidity, and barometric pressure (if a weather station is installed). The data storage device can be a hard disc drive, a CD-R, DVD-R or other optically writable drive, or any suitable data storage unit able to reliable handle data at the expected rate and quantity needed here. The weather station can include any or all of the following: temperature sensors, humidity sensors, barometric pressure sensors, and rain gauges. The data communications system can be any appropriate telecom transmission device, and can be wireless if desired. The purpose of this communications system is to allow the railway staff or other appropriate parties to review the condition of each grade crossing 12, to issue commends to and monitor each processor at particular stations, and to permit the retrieval of data from potentially many grade crossing locations.

There are several ways warning signal notification can be achieved. The simplest way is already widely used in the railway industry. As shown in FIG. 13, warning lights 504 can be installed at designated distances from a grade crossing 12. Such warning lights 504 installed at more than one distance can be used so that various levels of urgency can be observed by a train engineer. The warning lights 504 can be arranged similar to street stoplights for automobiles. A green light at the first tier observing position can indicate that a crossing 12 is clear, and that the train can proceed at full speed. A yellow light at the same location can indicate that an object 22 is passing through the crossing 12 but with adequate speed to be clear when the train actually approaches the crossing 12. And a red light at the same location can indicate that an object 22 is blocking or stationary in the crossing 12.

At a closer observing position (a second tier observation position), even a moving object 22 without adequate speed can trigger the red light warning to the train engineer to stop the train. With appropriate selection of distances, this will provide adequate braking distance for the train to fully stop before reaching the grade crossing 12. In sum, the use of multiple tiers of observation positions gives the train engineer abundant opportunities to evaluate the safety condition at a crossing 12 and to take proper action before arriving there.

The control unit 502 (e.g., in a card cage) can be installed either near a grade crossing 12 or in a nearby train station. It will usually be more economical if the hardware is installed near the crossing 12, since data retrieval and command issuance can be accomplished by wireless telecommunications. In most cases, electrical power for the inventive hazard mitigation system 10 can be acquired from a power source already present for another purpose. Of course, the control unit 502 even can be made quite compact and can be mounted on a signal light post.

More sophisticated notification mechanisms may be used in the hazard mitigation system 10, including ones that can send warning signals to the train engineer via a wireless telephone device, or send the warning to a nearby train station to let the station controller issue a warning signal to the train engineer. All these mechanisms can be used and are mainly dependent on the budget of the train company or government body responsible for railway grade crossing safety.

Since this invention depends on the weight of the object 22, it is not affected by weather conditions. It is also durable and reliable. More importantly, its implementation is simple and its installation and upkeep should easily be within the capability of ordinary railway maintenance workers.

While various embodiments have been described above, it should be understood that they have been presented by way of example only, and not limitation. Thus, the breadth and scope of the invention should not be limited by any of the above described exemplary embodiments, but should be defined only in accordance with the following claims and their equivalents.

What is claimed is:

1. A system for hazard mitigation related to an object in a highway-railway grade crossing, wherein the railway has a pair of tracks at the crossing, comprising:

a structure including a fixed foundation and a surface layer cushionably placed above said foundation, wherein said structure is located between the pair of tracks at the crossing;

at least one sensor mounted between said surface layer and said foundation, wherein said sensor senses the weight of the object upon said surface layer and provides a sensor signal representative of said weight; and a control unit to receive said sensor signal, to process said sensor signal to determine whether the object represents a potential hazard, and, if so to generate a warning signal.

2. The system of claim 1, wherein said sensor includes a pressure gauge.

3. The system of claim 1, wherein said sensor includes a strain gauge.

4. The system of claim 3, wherein said strain gauge is fixedly mounted with respect to said foundation and said sensor further includes a tension wire fixedly connected at one end and at the other end to said strain gauge such that movement of said surface layer due to the weight of the object activates said sensor to provide said sensor signal.

5. The system of claim 4, wherein said tension wire is of a low thermal expansion material.

6. The system of claim 1, wherein:

said sensor includes a fiber optic sensor; and said control unit includes a light source to provide a light beam to said sensor, wherein said light beam includes at least one wavelength chosen based on a response characteristic of said fiber optic sensor.

7. The system of claim 6, wherein said fiber optic sensor is a member of the set consisting of athermal type devices and devices having a normalizing mechanism that compensates for temperature variation.

8. The system of claim 6, wherein:

multiple said sensors are employed in the system; and said multiple said sensors are interconnected with optical fiber in a configuration that is a member of the set consisting of serial connections, parallel connections, and combinations thereof.

9. The system of claim 8, wherein said light source includes a narrow line-width tunable laser.

10. The system of claim 8, wherein said light source provides said light beam having a broadband spectrum of wavelengths consisting of all the wavelengths of said multiple said sensors.

11. The system of claim 6, wherein said fiber optic sensor includes at least one member of the set consisting of Fabry-Perot gratings, Mach-Zehnder interferometers, Fizeau interferometers, and Michelson interferometers.

12. The system of claim 6, wherein said fiber optic sensor includes a fiber Bragg grating.

13. The system of claim 1, wherein:

said control unit includes a signal comparator, a processor, a data storage, and a communications system; and wherein said signal comparator evaluates said sensor signal based on pre-stored data in said data storage; and said control unit directs said signal comparator, monitors said sensor signal, determines whether the object represents a potential hazard based on externally obtained contemporaneous information about the crossing, generates said warning signal, and directs said communications system to externally communicate said warning signal, thereby permitting a human operator or an automated system to act based on said warning signal.

14. The system of claim 13, wherein said control unit further includes a weather station including at least one member of the set consisting of temperature sensors, humidity sensors, barometric pressure sensors, and rain gauges.

15. The system of claim 13, wherein said communications system includes a wireless telecommunications device.

* * * * *